US008590188B2

(12) United States Patent
Mirsch

(10) Patent No.: US 8,590,188 B2
(45) Date of Patent: Nov. 26, 2013

(54) INFORMATION PRESENTING DEVICE

(75) Inventor: Jani Mirsch, Ramlösa (SE)

(73) Assignee: Mizelda AB, Helsingborg (SE)

( * ) Notice: Subject to any disclaimer, the term of this patent is extended or adjusted under 35 U.S.C. 154(b) by 30 days.

(21) Appl. No.: 13/059,127

(22) PCT Filed: Aug. 14, 2009

(86) PCT No.: PCT/SE2009/000380

§ 371 (c)(1),
(2), (4) Date: Apr. 8, 2011

(87) PCT Pub. No.: WO2010/019086

PCT Pub. Date: Feb. 18, 2010

(65) Prior Publication Data

US 2011/0179685 A1 Jul. 28, 2011

(30) Foreign Application Priority Data

Aug. 15, 2008 (SE) ..... 0801798

(51) Int. Cl.
*G09F 15/00* (2006.01)

(52) U.S. Cl.
USPC ..... 40/610; 40/124.07; 40/124.08; 446/85; 248/174

(58) Field of Classification Search
USPC ..... 40/600, 610, 124.08, 539; 446/486, 487
See application file for complete search history.

(56) References Cited

U.S. PATENT DOCUMENTS

| | | | | |
|---|---|---|---|---|
| 1,545,771 | A * | 7/1925 | Hout | 229/107 |
| 2,160,724 | A * | 5/1939 | Fletcher | 40/603 |
| 2,862,322 | A * | 12/1958 | Ziegler | 40/738 |
| 3,234,682 | A * | 2/1966 | Frankl | 446/85 |
| 5,383,292 | A * | 1/1995 | Whittredge | 40/124.08 |
| 6,347,772 | B1 * | 2/2002 | L'Hotel | 248/174 |
| 7,634,865 | B2 * | 12/2009 | L'Hotel | 40/610 |
| 7,726,054 | B2 * | 6/2010 | Mestres Armengol et al. | 40/124.07 |
| 7,774,964 | B2 * | 8/2010 | L'Hotel | 40/539 |
| 8,099,883 | B2 * | 1/2012 | Mestres Armengol et al. | 40/124.07 |
| 2008/0083146 | A1 | 4/2008 | Martin Presa | |

FOREIGN PATENT DOCUMENTS

| | | | |
|---|---|---|---|
| FR | 2897970 | A1 | 8/2007 |
| FR | 2911425 | A1 | 7/2008 |
| WO | 2007/092440 | A2 | 8/2007 |

* cited by examiner

*Primary Examiner* — Joanne Silbermann
*Assistant Examiner* — Shin Kim
(74) *Attorney, Agent, or Firm* — Ladas & Parry LLP

(57) ABSTRACT

An information presenting device. The device is arranged to be capable of assuming a first flattened configuration, for transport or storage, and of assuming a second extended and hence self-supporting configuration. The device comprises at least two panels joined together along the respective edges of at least two of the panels such that the device, having assumed the second configuration, forms a hollow cylinder, and at least one locking member, arranged between the panels 4, for continuously adjustable locking of the device in the first or second configuration, the locking member comprising a first part and a second part, the first part being slidably connected to the second part and the locking member being self-locking by a friction band coupling formed between contact surfaces of the first part and the second part of the locking member.

10 Claims, 4 Drawing Sheets

INFORMATION PRESENTING DEVICE

TECHNICAL FIELD

The present invention relates to an information presenting device, which device is arranged to be capable of assuming a first configuration, in which the device is flattened for transport or storage, and of assuming a second configuration, in which the device is extended and hence self-supporting. The invention further relates to a method for extending a device according to the above from the first, flattened configuration into the second, extended configuration.

BACKGROUND ART

The presentation of information such as notices or advertising at sales outlets, so-called shop advertising, is nowadays common practice. A common way of presenting the information is by means of posters of different kinds. The use of posters or the like has drawbacks, such as that the posters have to be hung up on something and are not particularly attractive to look at. Advertising by means of self-supporting advertising pillars has therefore become increasingly common. A drawback with the transport and storage of advertising pillars is that they occupy a large amount of space. This has been solved by providing advertising pillars which can be flattened during transport and storage and which can be extended when in use at, for example, the sales outlet. Some examples of advertising pillars of this type are described below.

In FR2730148 an advertising pillar is described, comprising two mutually opposing panels which can be extended from a flat configuration into a convexly extended configuration. The advertising pillar also comprises supporting members in the form of strips, which see to it that the extended shape is maintained when the advertising pillar is used. The supporting members are hooked together in the middle when the advertising pillar is put up.

In DE4314654 an advertising pillar is described, comprising two mutually opposing panels. The advertising pillar is extended into a convex shape with the aid of at least one tensioning element. Said tensioning elements hold the side edges of the advertising pillar closer together than if they were not subjected to the tensioning force of said tensioning element. The extended, convex shape is thereby maintained.

A drawback with both these solutions is that a tensioning element needs to be fitted to the advertising pillar, or alternatively a supporting member needs to be hooked together in order to maintain the extended configuration. Both of these solutions are cumbersome for the user, since the user must actively fit the tensioning element, or alternatively must actively hook together a supporting member.

In the literature, advertising pillars of the abovementioned kind which are extended automatically are also described. Some examples are disclosed in the following publications.

In GB2370977 an advertising pillar is described, comprising two mutually opposing panels. The advertising pillar can be in a first, collapsed configuration (transport/storage configuration) and a second, extended configuration (display configuration). In order to extend the advertising pillar from the first configuration into the second configuration, the advertising pillar comprises pretensioned members, which are pretensioned and extended when the advertising pillar is in the first configuration and which are then contracted when the advertising pillar is to be in the second configuration. The advertising pillar can hence be automatically extended from the first configuration into said second configuration.

In WO2006037896 an advertising pillar comprising at least one panel is described, but two mutually opposing panels are also mentioned. The advertising pillar can be in a first, collapsed configuration (transport/storage configuration) and a second, extended configuration (display configuration). In order to extend the advertising pillar from the first configuration into the second configuration, the advertising pillar comprises elastic bands, which are pretensioned and extended when the advertising pillar is in the first configuration and which are then contracted when the advertising pillar must be in the second configuration. The advertising pillar further comprises inserts for maintaining the convex surface when the advertising pillar is in the second configuration. These inserts have a length conforming to the distance between the edges of the advertising pillar when it is in the second configuration.

In US2007/0245610 an advertising pillar is described, comprising two mutually opposing panels similar to those described in GB2370977 and WO2006037896, i.e. the advertising pillar is automatically self-extending with the aid of elastic bands. US2007/0245610 also has pressure elements (these, too, elastically tensioned), which press on the inner side of the advertising pillar in order to maintain a "neat" convex presentation surface.

One drawback with the above-described, automatically extended advertising pillars is precisely the automatic extension. The automatic extension is obtained by means of pretensioned tensioning elements. This means that an advertising pillar which is in the first, transport/storage configuration will automatically assume the second, extended configuration, i.e. the pretensioning in the pretensioned tensioning elements must be overcome in order to obtain the first configuration.

Another drawback is that the tensioning elements (for example the elastic bands) are made of rubber or some other elastic material, thereby making the advertising pillar more difficult to recycle.

Yet another drawback is that the tensioning elements age, which causes the possible storage time for the advertising pillars to be shortened.

SUMMARY OF THE INVENTION

One object of the present invention is to provide an information presenting device which is easy to extend from a first, flattened configuration into a second, extended configuration.

One more object of the present invention is to provide an information presenting device which is easy to recycle.

In order to achieve at least one of these objects, as well as other objects which will emerge from the following description, an information presenting device is identified according to the present invention. The device is arranged to be capable of assuming a first configuration, in which the device is flattened for transport or storage, and of assuming a second configuration, in which the device is extended and hence self-supporting. The device comprises at least two panels, made of a rigid material, which are joined together along the respective edges of at least two of the panels such that the device, having assumed the second configuration, forms a hollow cylinder, and at least one locking member, arranged between said panels, for continuously adjustable locking of the device in said first or second configuration, the locking member comprising a first part and a second part, the first part being slidably connected to the second part and the locking member being self-locking by a friction band coupling formed between contact surfaces of the first part and the second part of the locking member.

A device has thus been provided which is easy to extend. Furthermore, the device is also easy to flatten following extension. This since the locking member acts to lock the device in both said first and said second configuration. This locking is realized automatically as long as the friction of the friction band coupling between the contact surfaces of the first part and the second part of the locking member is not overcome. The fact that the first part of the locking member is slidably connected to the second part of the locking member together with the fact that the locking of the device is continuously adjustable means that the device can assume all conceivable configurations between the two extremes to which the first, flattened configuration and the second, extended configuration correspond. The sliding connection between the first and second part of the locking member is continuously adjustable, i.e. stepless. In one or other of the two configurations (or some configuration therebetween), the device is in its state of rest, i.e. in order to alter the configuration of the device, a force which overcomes the friction of the friction band coupling between said first and second part of the locking member must be overcome. The rigidity of the panels, together with the cylindrical configuration of the device, results in the device, in its extended, second configuration, being self-supporting. A device of said type is simple to produce and assemble, which makes the production relatively cheap.

The locking member can be made of similar material to said at least two panels. By similar material is meant, for example, paper fibers. By producing all the parts of the device in similar material, recycling of the device is made considerably easier. Upon disposal, the various parts of the device do not need to be separated from one another, but rather it is possible to throw away the whole device as, for example, cardboard, if the device is now made of paper fibers. It will be appreciated, however, that other materials can also be used, for example the whole of the device can be produced in plastics material.

A portion of the first part of the locking member can be inserted in a first recess in the second part of the locking member. In this way, a large contact surface between the first and second part of the locking member can be achieved and thus a reliable friction band coupling is achieved. A large contact surface gives rise to the necessary friction between the parts of the locking member.

The first part of the locking member can be formed by a tongue. The second part of the locking member can be formed by a doubled-over strip. A tongue which is inserted into a doubled-over strip can generate the necessary friction in order to form the friction band coupling in a simple manner.

The locking member can further comprise a stop member. The stop member can be configured as a protrusion on the first part of the locking member. The protrusion can extend perpendicular to the extent of the tongue. Hence it is not possible to feed the first part of the locking member into the second part of the locking member beyond the point at which the stop member comes to bear against the second part of the locking member. Once the device has attained said second configuration, the stop member bears against the second part of the locking member, i.e. the locking member reaches a stop position. The stop position is reached when the device reaches its second, extended configuration. Thus, a number of different devices can be extended to assume a similar configuration.

The material which makes up the panels can be foldable. Each panel can hence be divided into sections, which allow the device to be folded up when it is in said first, flattened configuration.

The material which makes up the panels can be flexible. Hence, the panels can be bent and can assume convex shapes which are required for certain embodiments of the invention.

The locking member can be fastened to longitudinal connecting lines between the panels.

According to another aspect of the present invention, a method for extending a device from the first, flattened configuration into the second, extended configuration is identified. The method comprises the application of a pressure force to the connecting lines of at least two of the panels of the device such that the friction of the friction band coupling between the contact surfaces of the first part and the second part of the locking member is overcome in order to attain said second, extended configuration, and the termination of said pressure force in order to maintain said second configuration through self-locking via the friction band coupling formed between the contact surfaces of the first part and the second part of the locking member.

Further fields of application, embodiments and advantages of the present invention are made clear in the detailed description below. It will be appreciated, however, that the detailed description and the quoted examples showing preferred embodiments of the invention are given as illustrative examples, since various changes and modifications within the scope of the invention will be evident to the person skilled in the art.

BRIEF DESCRIPTION OF THE DRAWINGS

The invention will be described in greater detail below for exemplifying purposes with reference to the appended drawings, which show presently preferred embodiments.

DETAILED DESCRIPTION OF PREFERRED EMBODIMENTS

Figure 1:
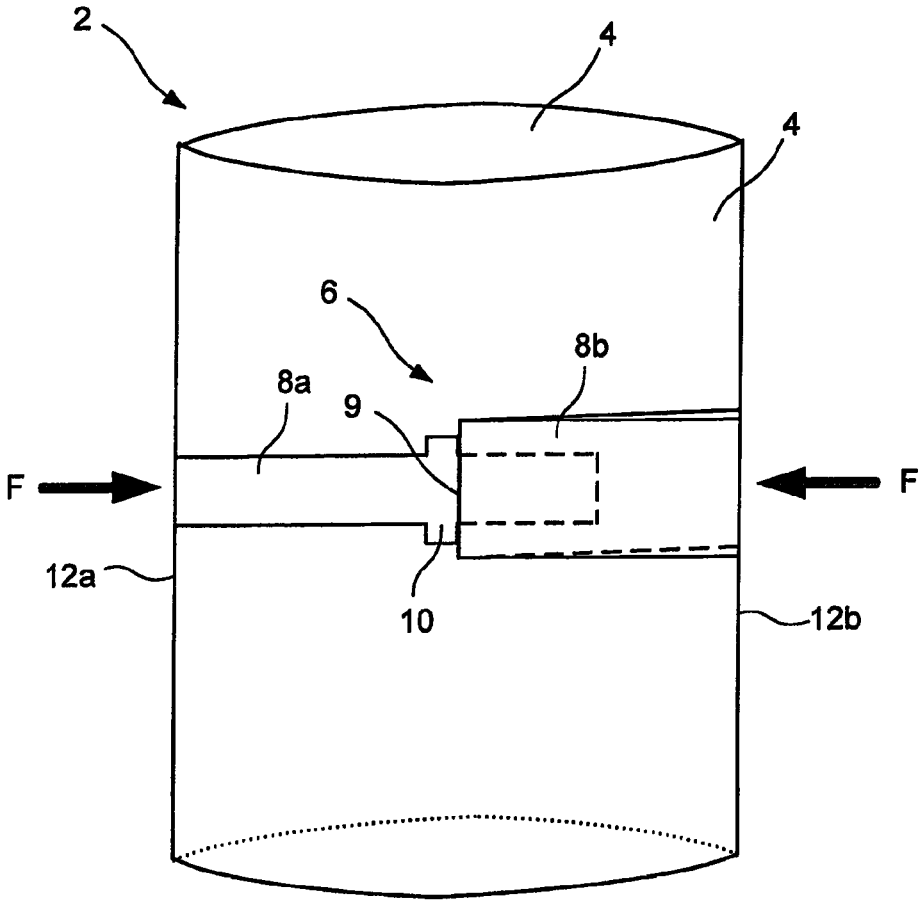
FIG. 1 is a side view of an embodiment of the invention. The shown embodiment has assumed the second, extended configuration.
Figure 2:
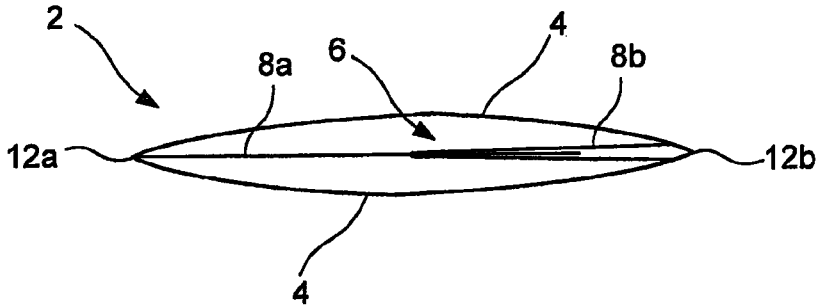
FIG. 2 is a top view of the embodiment shown in FIG. 1.

In FIGS. 1 and 2, an embodiment of the information presenting device 2 according to the invention is illustrated. The embodiment is shown in its second configuration, in which the device 2 is extended and hence self-supporting. The device 2 is also arranged to assume a first configuration, in which the device 2 is flattened for transport or storage, see FIGS. 4 and 5 and the description below.

That embodiment of the device 2 which is shown in FIGS. 1 and 2 comprises two panels 4. It will be appreciated that the device 2 can comprise more than two panels. Examples of embodiments having more than two panels are discussed below with reference to FIGS. 6*a* and 6*b*. The panels are made of a rigid, yet flexible material. For example, the material can be corrugated board or box board. The rigidity makes the device self-supporting in its extended, second configuration. The flexibility allows the panels to be bent and thus assume a convex shape, like the embodiment shown in FIGS. 1 and 2. The material which makes up the panels 4 can also be foldable, which characteristic will be discussed in greater detail below. The panels 4 are joined together along the respective longitudinal edges of the panels 4 such that the device 2, when it has the illustrated second, extended configuration, forms a hollow cylinder.

The information (for example advertising) to be shown by means of the device 2 is applied to the outer sides of the panels 4. The information can be applied, for example, by means of pressing, gluing, adhesion, etc.

The device further comprises a locking member 6 for locking of the device 2 in at least said first and second configuration. The locking member 6 is arranged between said panels 4, i.e. the locking member 6 is situated inside the hollow cylinder formed in the second configuration. The locking member 6 sits fastened to the longitudinal connecting lines 12*a*, 12*b* of the panels 4. The locking member 6 is arranged perpendicular to the longitudinal lengthwise direction of the panels 4. The locking member 6 comprises at least two parts 8*a*, 8*b*. A first part 8*a* is slidably connected, in a continuously adjustable manner, to a second part 8*b*. The locking member 6 being self-locking by a friction band coupling between contact surfaces of the first part 8*a* and second part 8*b* of the locking member 6. The first part 8*a* can be regarded as a male part and the second part 8*b* can be regarded as a female part in a friction band coupling. The friction band coupling may be formed between the plane contact surfaces of the male part and female part. Alternatively, the friction band coupling may be formed at the contact surfaces between the male and female parts in the area where the male part is entering the female part.

It will also be appreciated that when the device 2 is between the first and the second configuration, then the locking member 6 is in an adjustable zone. Unless more force is supplied when the locking member 6 is in this adjustable zone, the device 2 maintains the shape which it momentarily has due to the friction of the friction band coupling between the contact surfaces of the first part 8*a* and the second part 8*b* of the locking member 6. The device 2 can thus also assume configurations which can be designated as partially extended.

The locking member 6 can be made of similar material to said panels 4. By similar material is meant, for example, paper fibres. By producing the locking member 6 in similar material to said panels 4, recycling of the device 2 is facilitated.

According to the embodiment shown in FIGS. 1 and 2, the first part 8*a* of the locking member 6 is formed by a tongue, and the second part 8*b* of the locking member 6 by a doubled-over strip. According to the above, the tongue can thus be described as a male part in a coupling, while the doubled-over strip can be designated as a female part in a coupling. A portion of the first part 8*a* of the locking member 6 is inserted in a first recess 9 in the second part 8*b* of the locking member 6. The first part 8*a* of the locking member 6 is hence slidably connected, in a continuously adjustable manner, to the second part 8*b* of the locking member 6. The first recess 9 can be a slot in the doubled-over strip of the second part 8*b* of the locking member 6. Said slot, constituting the first recess 9, can be situated in the fold line of the doubled-over strip. Alternatively, said slot, constituting the first recess 9, can be situated as a pocket on the one plane surface of the doubled-over strip. Friction is generated between that portion of the first part 8*a* of the locking member 6 which is inserted in the first recess 9 of the second part 8*b* of the locking member 6 and the second part 8*b* of the locking member 6 and thus the friction band coupling is formed. The friction band coupling between the contact surfaces of the first part 8*a* and the second part 8*b* of the locking member 6 thus ensures that the device 2 is kept in the configuration in which the device is momentarily found.

The first part 8*a* of the locking member 6 is fastened to a first connecting line 12*a* between two panels 4 of the device 2. The second part 8*b* of the locking member 6 is fastened to a second connecting line 12*b* between two panels 4 of the device 2.

The locking member can also comprise a stop member 10. The stop member 10 can be configured as a protrusion on the first part 8*a* of the locking member 6. The protrusion can have an extent perpendicular to the extent of the first part 8*a*. Hence it is not possible to feed the first part 8*a* of the locking member 6 into the second part 8*b* of the locking member 6 beyond the point at which the stop member 10 comes to bear against the second part 8*b* of the locking member 6. Once the device 2 has attained said second configuration, the stop member 10 bears against the second part 8*b* of the locking member 6, i.e. the locking member 6 reaches a stop position.

Figure 3:
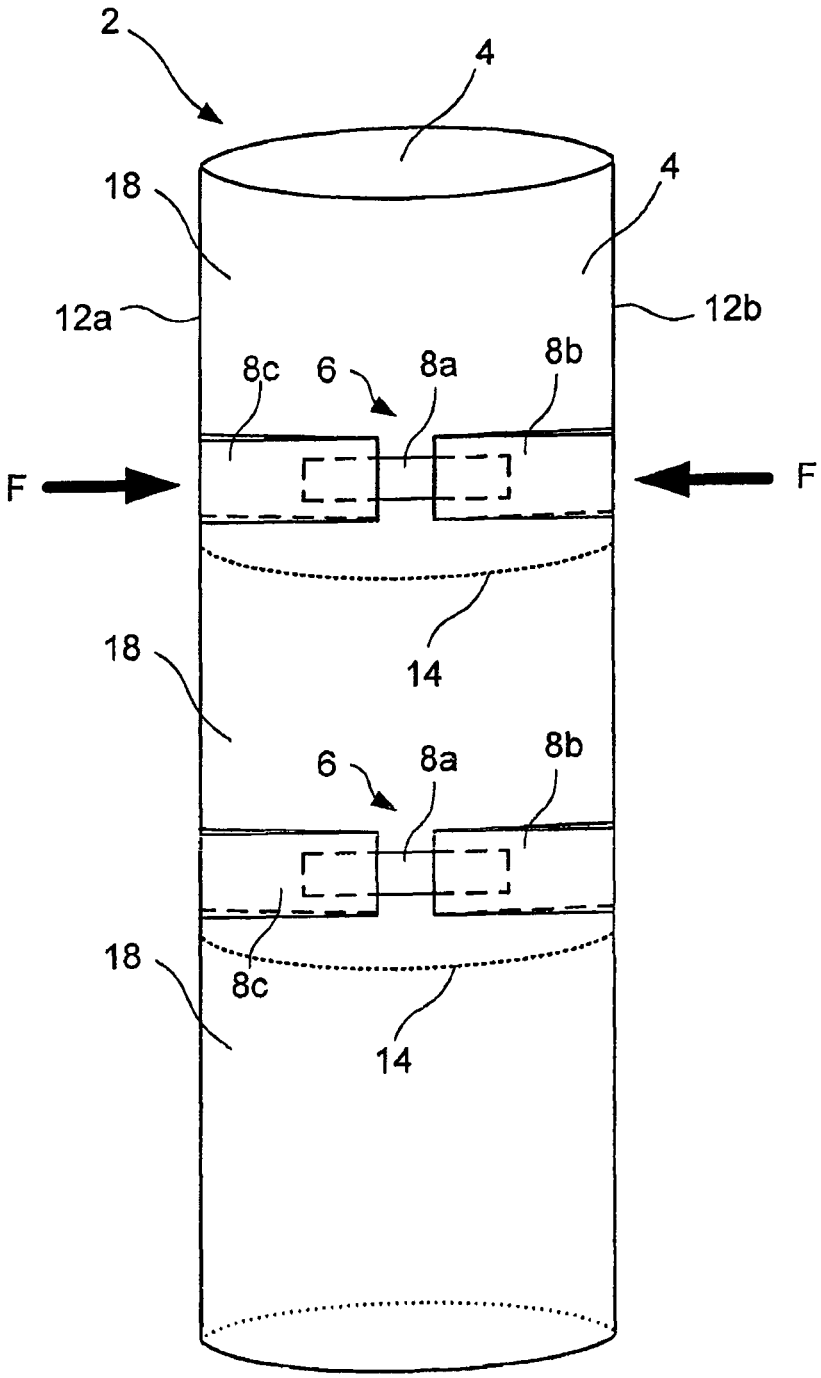
FIG. 3 is a side view of an alternative embodiment of the invention. The shown embodiment has assumed the second, extended configuration.

In FIG. 3, an embodiment of the device according to the invention is illustrated. Here an alternative locking member 6 is shown. In connection with the description of this embodiment, reference is also made to that described above concerning the configuration and working of the locking member 6. This embodiment of the locking member 6 comprises, in addition to the first part 8*a* and the second part 8*b*, also a third part 8*c*. The third part 8*c* can be identical with the second part 8*b*. The third part 8*c* can also be mirror inverted relative to the second part 8*b*. The third part 8*c* is fixed to the first connecting line 12*a* between two panels 4 of the device 2. In this embodiment, the first part 8*a* can be slidably connected, in a continuously adjustable manner, to both the second part 8*b* and the third part 8*c* of the locking member 6. Alternatively, the first part 8*a* can be fixed in the third part 8*c* and thus be only slidably connected, in a continuously adjustable manner, to said second part 8*b*.

Figure 4:
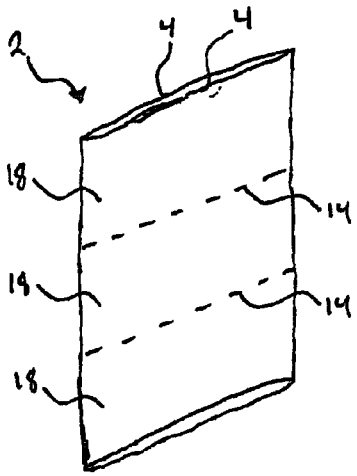
FIG. 4 is a side view of the embodiment shown in FIG. 3. The shown embodiment assumes a first, flattened configuration.
Figure 5:
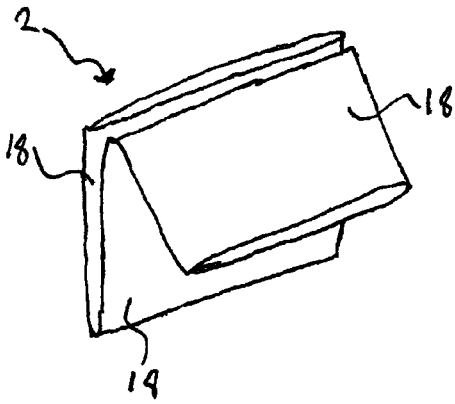
FIG. 5 is a side view of the embodiment shown in FIGS. 4 and 5. The shown embodiment has assumed the folded-up, flattened configuration.

Also illustrated in FIG. 3 are fold lines 14, along which the device can be folded when it is in said first, flattened configuration. These fold lines can be formed by creases in the panels 4. Such fold lines are applicable regardless of the embodiment. In order to make this folding possible, the panels 4 consist of a foldable material. The fold lines 14 extend transversely between the longitudinal connecting lines (12*a* and 12*b* in the shown embodiment) of the panels 4. The respective panel 4 is hence divided into mutually corresponding sections 18. Each individual section 18 can have an equally large longitudinal extent. As a result of this, the device 2 can be folded, by folding along the fold lines 14, from the first, flattened configuration as illustrated in FIG. 4 into a folded-up configuration as illustrated in FIG. 5.

The number of sections 18 can advantageously be odd. Folding along the middle of the device 2, which has been shown in tests to be the most fragile part of the device 2, is thereby avoided.

In the embodiment shown in FIG. 3, a locking member 6 is fitted inside respectively the uppermost and the middlemost section 18. It will be appreciated, however, that the number of locking members 6, and their placement, can be varied, all to obtain as stable a device 2 as possible when the device 2 is in its said second, extended state. The placement of the locking members 6 should also be chosen such that the extension into the second, extended configuration is facilitated. The placement shown in FIG. 3 is a presently preferred placement in terms of the above characteristics. This since the two locking members give a stable device when the device is in its second, extended configuration, and since the placement of the locking members facilitates the extension into said second, extended configuration.

In case of use, the device 2 is delivered in the folded-up configuration as has been described above. The device 2 is brought from this folded-up, flat configuration into the second, extended configuration by the following process: First, the folded-up, flat device 2 is unfolded to assume its first, flattened configuration. After this, the flattened, first configuration is extended to assume the second, extended configuration. This is done by applying the pressure force F to the connecting lines 12*a*, 12*b* of two of the panels 4 of the device 2 such that the friction of the friction band coupling between the contact surfaces of the first part 8*a* and the second part 8*b* of the locking member 6 is overcome and the parts 8*a*, 8*b* slide one against the other. The application of the pressure force F can be realized manually. When said pressure force F ceases to act, said second configuration is maintained through self-locking via the friction band coupling formed between the contact surfaces of the parts 8*a*, 8*b*, 8*c* of the locking member 6.

The device 2 can further be flattened from said second, extended configuration into said first, flattened configuration, for possible further folding-up, by a similar process to the above. First, the connecting lines 12*a*, 12*b* of two of the panels 4 of the device 2 are pushed or pulled away from each other such that the friction of the friction band coupling between the contact surfaces of the first part 8*a* and the second part 8*b* of the locking member 6 is overcome, for example by pressing on the panels. The applied tensile or pressure force is maintained until said first, flattened configuration is obtained. Now the device 2 can be folded along the length of the fold lines 14 in order to obtain the folded-up configuration. It will be appreciated that the device does not necessarily need to be designed for folding. The extent to which folding shall be possible or not depends on the size of the device 2.

The material which is used to produce the panels or the locking member can comprise a corrugated layer (for example corrugated board). As is well known to the person skilled in the art, a material having a corrugated layer is rigid in one direction and bendable in a direction perpendicular to the rigid direction.

Panels 4 made of a material comprising a corrugated layer advantageously have their rigid direction in the longitudinal direction of the panels 4. In this way, maximal rigidity is obtained in the device 2 and the device acquires maximal self-supporting capacity. The panels 4 are also bendable in the transverse direction, which is useful for certain embodiments.

Locking members 6 made of a material comprising a corrugated layer advantageously have their rigid direction in the sliding direction of the locking member 6. In this way, maximal rigidity is obtained in the locking members 6.

Figure 6A:
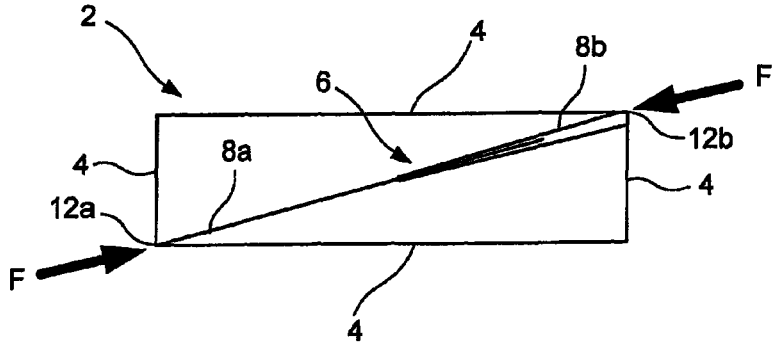
FIG. 6*a* is a top view of an embodiment of a device according to the invention having four panels. The panels are joined together along the respective longitudinal edges of the panels such that the device, when it has the illustrated second, extended configuration, forms a hollow cylinder of rectangular cross section.
Figure 6B:
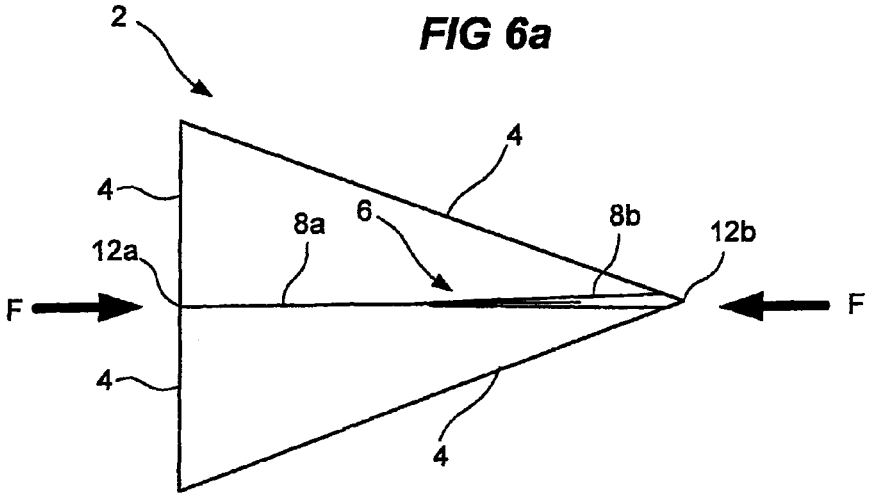
FIG. 6*b* is a top view of an embodiment of a device according to the invention having four panels. The panels are joined together along the respective longitudinal edges of the panels such that the device, when it has the illustrated second, extended configuration, forms a hollow cylinder of triangular cross section.

In FIGS. 6*a* and 6*b*, two alternative embodiments of a device according to the invention 2 are illustrated. FIGS. 6*a* and 6*b* are top views of the two alternative embodiments.

FIG. 6*a* shows an embodiment of a device according to the invention having four panels 4. The panels 4 are joined together along the respective longitudinal edges of the panels 4 such that the device 2, when it has the illustrated second, extended configuration, forms a hollow cylinder of rectangular cross section. In this case too, the device 2 comprises a locking member 6. The locking member 6 is constructed and works in the same way as described above. The locking member 6 is arranged between said panels 4, i.e. the locking member 6 is situated inside the hollow cylinder formed in the second configuration. The first part 8*a* of the locking member 6 is fixed to a first connecting line 12*a* between two panels 4 of the device 2. The second part 8*b* of the locking member 6 is fixed to a second connecting line 12*b* between two panels 4 of the device 2. The first connecting line 12*a* and the second connecting line 12*b* lie diagonally opposite one another.

FIG. 6*b* shows an embodiment of a device according to the invention which likewise has four panels 4. The panels 4 are joined together along the respective longitudinal edges of the panels 4 such that the device 2, when it has the illustrated second, extended configuration, forms a hollow cylinder of triangular cross section. In this case too, the device 2 comprises a locking member 6. The locking member 6 is constructed and works in the same way as described above. The locking member 6 is arranged between said panels 4, i.e. the locking member 6 is situated inside the hollow cylinder formed in the second configuration. The first part 8*a* of the locking member 6 is fixed to a first connecting line 12*a* between two panels 4 of the device 2. The second part 8*b* of the locking member 6 is fixed to a second connecting line 12*b* between two panels 4 of the device 2. The first connecting line 12*a* is situated in the middle of one side of the triangle, which side is divided into two panels 4. The second connecting line 12*b* is situated in that corner of the triangle which is opposite to the side to which the first part 8*a* of the locking member 6 is fixed.

Figure 7:
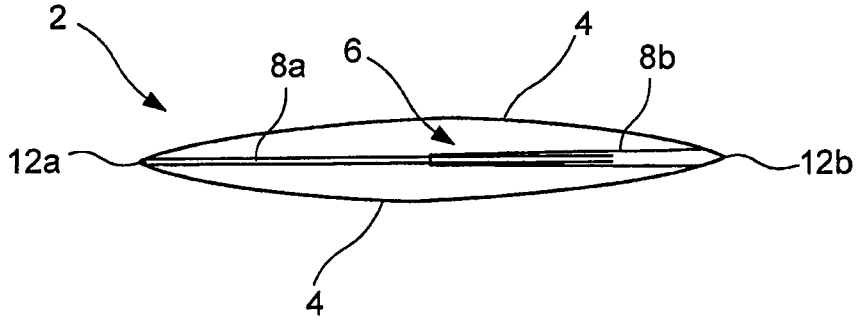
FIG. 7 is a top view of an embodiment of the locking member of the device.
Figure 8:
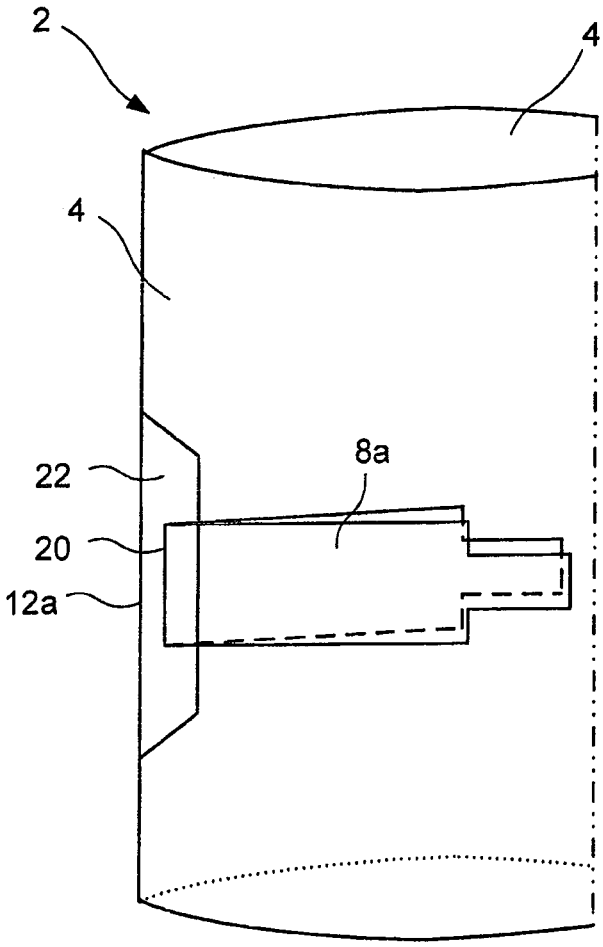
FIG. 8 is a side view of the fastening of the first part of the locking member shown in FIG. 7.

FIG. 7 shows an embodiment of a device according to the invention which has an alternative configuration of the locking member 6. In connection with the description of this alternative embodiment, reference is also made to that described above concerning the configuration and working of the locking member 6. In this embodiment, the first part 8*a* of the locking member 6 (the male part) is doubled-over. The first part 8*a* of the locking member 6 is thus formed by two layers of material. This increases the rigidity of the first part 8*a* of the locking member 6. As is shown in FIG. 8, this embodiment of the locking member 6 facilitates the fastening of the first part 8*a* of the locking member 6 to the first connecting line 12*a* between two panels 4 of the device. This since the first part 8*a* of the locking member 6 can be fastened, via a second recess 20 in a first pocket 22, to the connecting line 12*a* between two panels 4 of the device. It will be appreciated that also the second part 8*b* of the locking member can be fastened, via a second pocket, to the connecting line 12*b* between two panels 4 of the device.

Each panel 4 can comprise folds having the same extent as the connecting lines 12*a*, 12*b* and can hence be divided into sub-panels. The folds can be configured as creases. When the device 2 is extended into its second, extended configuration, it has in this case a polygonal cylinder in which the number of corners is determined by the number of connecting lines 12*a*, 12*b*, together with the number of abovementioned folds having the same extent as the connecting lines 12*a*, 12*b*.

Through the application of further panels to the device 2, in the form of a lid and/or bottom to the cylinder, when it is in its second, extended configuration, the device 2 can have yet more surfaces, on which surfaces information can be shown.

A number of modifications and variations are hence possible, so that the present invention is limited solely by the accompanying claims.

The invention claimed is:

1. An information presenting device, which device is arranged to be capable of assuming a first configuration, in which the device is flattened for transport or storage, and of assuming a second configuration, in which the device is extended and hence self-supporting, said device comprising:

at least two panels, made of a rigid material, which are joined together along the respective edges of at least two of the panels such that the device, having assumed the second configuration, forms a hollow cylinder, wherein at least one locking member is arranged between said panels for continuously adjustable locking of the device in at least said first and second configuration, respectively, the locking member comprising a first part and a second part, the first part being slidably connected to the second part and the locking member being self-locking by a friction band coupling formed between contact surfaces of the first part and the second part of the locking member, wherein the device does not comprise a pretensioned tensioning element that biases the panels to the second configuration and that must be overcome in order to obtain the first configuration; and wherein the at least one locking member is fastened to an inside of the device at two separate fastening portions.

2. A device according to claim 1, wherein said locking member is made of similar material to said at least two panels.

3. A device according to claim 1, wherein a portion of the first part of the locking member is inserted in a first recess in the second part of the locking member.

4. A device according to claim 1, wherein the first part of the locking member is formed by a tongue.

5. A device according to claim 1, wherein the second part of the locking member is formed by a doubled-over strip.

6. A device according to claim 1, wherein the locking member further comprises a stop member.

7. A device according to claim 1, wherein the material which makes up the panels is foldable.

8. A device according to claim 1, wherein the material which makes up the panels is flexible.

9. A device according to claim 1, wherein the locking member is fastened to longitudinal connecting lines between the panels.

10. A method for extending a device according to claim 1 from the first, flattened configuration into the second, extended configuration, comprising:

the application of a pressure force F from outside the device to the connecting lines of at least two of the panels of the device such that the friction of the friction band coupling present between the contact surfaces of the first part and the second part of the locking member is overcome in order to attain said second, extended configuration, and the termination of said pressure force F in order to maintain said second configuration through self-locking via the friction band coupling formed between the contact surfaces of the first part and the second part of the locking member.

* * * * *